US009752306B2

(12) United States Patent
Scamuffa

(10) Patent No.: US 9,752,306 B2
(45) Date of Patent: Sep. 5, 2017

(54) WASTE STRAINER

(71) Applicant: Nicholas Scamuffa, West Chester, PA (US)

(72) Inventor: Nicholas Scamuffa, West Chester, PA (US)

( * ) Notice: Subject to any disclaimer, the term of this patent is extended or adjusted under 35 U.S.C. 154(b) by 0 days.

(21) Appl. No.: 15/286,265

(22) Filed: Oct. 5, 2016

(65) Prior Publication Data

US 2017/0101769 A1 Apr. 13, 2017

Related U.S. Application Data

(60) Provisional application No. 62/238,955, filed on Oct. 8, 2015.

(51) Int. Cl.
*E03C 1/26* (2006.01)

(52) U.S. Cl.
CPC ..... *E03C 1/26* (2013.01)

(58) Field of Classification Search
None
See application file for complete search history.

(56) References Cited

U.S. PATENT DOCUMENTS 2,317,707 A * 4/1943 Yavitch ..... E03C 1/264 4/292
D189,080 S * 10/1960 Hauser ..... D23/261
3,982,289 A 9/1976 Robbins
4,134,162 A 1/1979 Sharland et al.
4,418,432 A 12/1983 Vidal
4,867,993 A * 9/1989 Nordskog ..... B65D 85/8043 426/110
5,228,153 A 7/1993 Frankel
5,271,108 A 12/1993 Wicke
5,439,128 A * 8/1995 Fishman ..... A45F 3/20 206/218
5,724,684 A 3/1998 Paar
5,734,999 A 4/1998 Nicholas
5,830,350 A * 11/1998 Voss ..... E04H 4/1272 210/167.12
6,103,116 A * 8/2000 Koslow ..... A47J 31/06 210/282
D454,177 S * 3/2002 Tracy ..... D23/261
(Continued)

FOREIGN PATENT DOCUMENTS

GB 2456579 A 7/2009
WO 0026548 A1 5/2000

*Primary Examiner* — Robert James Popovics
(74) *Attorney, Agent, or Firm* — Cozen O'Connor

(57) ABSTRACT

A strainer may include a basket portion and a handle or tower portion attached to the basket portion. The handle portion may project away from the basket portion and may be movable between a deployed position and a compressed position, for instance by applying a downward force on the handle portion. The top end of the handle portion may be above the flange of the basket portion, and the handle portion may include a plurality of openings to permit passage of liquid through the handle portion even if the basket portion is filled with waste. The handle portion may be formed of a plurality of sections, and the sections may fold over each other in an accordion configuration in the compressed position. The handle portion may also be resilient, such that the handle portion naturally returns to its deployed position after being moved into its compressed position.

4 Claims, 5 Drawing Sheets

(56) References Cited

U.S. PATENT DOCUMENTS 6,442,774 B2 9/2002 Wilson et al.
6,453,482 B1 9/2002 Mullings
6,588,029 B2 7/2003 Mullings
6,607,054 B1 8/2003 Lindfield
6,609,257 B1 8/2003 O'Geary
D517,175 S * 3/2006 Holsen ..... D23/261
7,032,253 B2 * 4/2006 Colpitts ..... A47K 1/14 4/287
D522,809 S * 6/2006 Kusuma ..... B65D 21/086 D7/545
D550,819 S * 9/2007 Seehoff ..... D23/261
D563,529 S * 3/2008 Labonte ..... D23/261
D564,307 S * 3/2008 Repp ..... D7/667
7,407,574 B2 8/2008 Robinson
7,442,296 B2 10/2008 Chong et al.
7,467,425 B2 * 12/2008 Harmes ..... A47K 1/14 4/286
D598,717 S * 8/2009 Jalet ..... D7/667
D599,444 S * 9/2009 Jones ..... D23/261
7,654,402 B2 * 2/2010 Kusuma ..... B65D 21/086 220/666
7,678,271 B2 * 3/2010 Curtin ..... A47J 43/24 141/337
7,736,499 B2 6/2010 Chong et al.
7,832,027 B2 11/2010 Escobar et al.
D630,306 S * 1/2011 Seehoff ..... D23/261
7,875,178 B2 * 1/2011 Ashliman ..... B01D 24/007 210/163
7,887,697 B2 2/2011 Worth
8,117,685 B2 * 2/2012 Escobar ..... E03C 1/262 4/286
8,171,574 B2 5/2012 Escobar et al.
D669,969 S 10/2012 Forrest et al.
D672,438 S 12/2012 Noel
D673,246 S * 12/2012 Lee ..... D23/260
8,409,433 B2 4/2013 Worth et al.
8,539,618 B2 9/2013 Gibson et al.
8,628,657 B1 1/2014 Robillard et al.
8,871,092 B2 * 10/2014 Curtin ..... A47J 43/22 141/337
8,881,679 B1 11/2014 Pelkey
D728,078 S * 4/2015 Scott ..... D23/261
D730,493 S * 5/2015 Sehl ..... D23/261
9,044,082 B2 * 6/2015 Kusuma ..... A45F 3/20
D739,209 S 9/2015 Lohmann
D745,821 S 12/2015 Lohmann
9,221,582 B2 * 12/2015 Wheeler ..... B65D 21/086
D749,706 S 2/2016 Johansen
9,334,641 B2 5/2016 Kobal
9,458,614 B2 10/2016 Muderlak et al.
9,493,933 B2 11/2016 Byron et al.
9,518,383 B2 12/2016 Lesmeister
D783,782 S * 4/2017 Scott ..... D23/261
2004/0107489 A1 6/2004 Caterina
2005/0127073 A1 * 6/2005 Kusuma ..... B65D 21/086 220/6
2005/0127074 A1 * 6/2005 Kusuma ..... B65D 21/086 220/6
2005/0283892 A1 12/2005 Simeone et al.
2006/0096929 A1 * 5/2006 Repp ..... A47J 19/00 210/740
2006/0207003 A1 * 9/2006 Harmes ..... A47K 1/14 4/286
2007/0181489 A1 * 8/2007 Lee ..... A47J 43/24 210/473
2007/0205144 A1 9/2007 Robinson
2007/0251874 A1 * 11/2007 Stewart ..... A47J 43/22 210/232
2007/0262006 A1 11/2007 Worth
2007/0272604 A1 11/2007 Chong et al.
2008/0083059 A1 4/2008 Escobar et al.
2008/0230469 A1 9/2008 Cherveny et al.
2009/0025128 A1 1/2009 Chong et al.
2010/0170840 A1 * 7/2010 Curtin ..... A47J 43/24 210/232
2010/0213111 A1 8/2010 Won
2010/0213140 A1 8/2010 Won
2011/0094021 A1 4/2011 Ychie
2013/0277364 A1 * 10/2013 Kusuma ..... A45F 3/20 220/8
2014/0053327 A1 * 2/2014 Lee ..... E03C 1/262 4/287
2014/0259349 A1 9/2014 Muderlak et al.
2015/0074891 A1 3/2015 Ychie
2015/0083736 A1 * 3/2015 Wheeler ..... B65D 21/086 220/666
2015/0284940 A1 10/2015 Kobal
2017/0101769 A1 * 4/2017 Scamuffa ..... E03C 1/26

* cited by examiner

WASTE STRAINER

CROSS REFERENCE TO RELATED APPLICATIONS

The present application claims priority to U.S. Provisional Patent Application No. 62/238,955, filed Oct. 8, 2015, which application is incorporated herein by reference in its entirety.

FIELD OF THE DISCLOSURE

This disclosure relates generally to waste strainers and, more particularly, drains having waste strainers such as those utilized with various types of sinks.

BACKGROUND

Sinks have a variety of sizes and environmental uses ranging from personal kitchens to large or industrial operations such as restaurants or laboratories. Many sinks are outfitted with a strainer or other kind of filter provided at or proximate to the sink drain. These strainers permit passage of liquid from the sink basin to the sink drain while capturing solid material, such as waste, within the strainer. In its most basic application, a typical strainer would have slits or openings sufficiently sized to permit the passage of liquid while blocking passage of waste material too large to pass through the slits or openings. Some known strainers, particularly those commonly found in household kitchen sinks, include a basket positioned within a portion of the sink drain, and the basket has a plurality of openings as well as a solid knob or handle protruding from the basket. A user of the sink may pull the knob away from the drain thereby removing the basket and its collected waste. The top of the knob is typically below, or possibly flush with, the top end of the basket so as to permit objects such as pots or pans to be placed on top of the inserted strainer without contacting the knob. Should the basket accumulate excessive waste, the liquid may no longer be able to pass through strainer, which in turn may cause the sink basin to unintentionally fill with liquid.

Strainers are not limited to use with sinks, and strainers be found in a variety of drains such as shower flooring. For example, strainers are also useful for collection of hair, or pet hair, which frequently clog shower or bath drains after use. In the prior art, typical strainers do not contain a central tower having openings, or a tower that extends above the lip of the flange, to provide a strainer that resists clogging.

BRIEF SUMMARY OF THE DISCLOSURE

The following presents a simplified summary of the disclosure in order to provide a basic understanding of some aspects of the invention. This summary is not an extensive overview of every embodiment disclosed herein. It is intended to neither identify key or critical elements of the various embodiments nor delineate the scope of the disclosure. Its sole purpose is to present some embodiments of the disclosure. In accordance with the various embodiments disclosed herein, in a simplified form as a prelude to the more detailed description that is presented later.

In one embodiment of the disclosure, a strainer may include a basket portion including a base surface provided at a base end, an outer basket wall projecting away from the base surface, a basket flange provided on the outer basket wall opposite the base end, and at least one basket opening to permit passage of liquid through the basket portion. The strainer may also include a handle portion attached to the basket portion and projecting away from the base end, the handle portion having a top end defined opposite the base end. The basket flange may be positioned between the top end and the base end in a deployed position.

In another embodiment of the disclosure, a strainer may include a basket portion including a base surface having a ring shape with an inner circumference and an outer circumference, the base surface provided at a base end, an outer basket wall projecting away from the outer circumference of the base surface, with the outer basket wall including a wall slit to permit passage of liquid through the outer basket wall, an inner basket wall projecting away from the inner circumference of the base surface, the inner basket wall including a support channel, and a basket flange provided on the outer basket wall opposite the base end. The strainer may also include a handle portion including a dome at or proximate to the top end, a passage proximate to the dome, a plurality of sections attached to the dome, and a protrusion attached to at least one of the plurality of sections, the protrusion conformingly dimensioned with the support channel and positioned within the support channel.

In certain embodiments, the handle portion may be movable between a deployed position and a compressed position, and the plurality of sections may fold over each other in an accordion configuration in the compressed position. The basket flange may be positioned between the top end and the base end in the deployed position and the basket flange may be positioned either substantially flush with the top end or the top end may be positioned between the basket flange and the base end in the compressed position.

The following description and the annexed drawings set forth certain illustrative aspects of the embodiments of the disclosure. These aspects are indicative, however, of but a few of the various ways in which the principles of the disclosure may be employed and the various embodiments are intended to include all such aspects and their equivalents. Other advantages and novel features will become apparent from the following description when considered in conjunction with the drawings.

DETAILED DESCRIPTION

Figure 1:
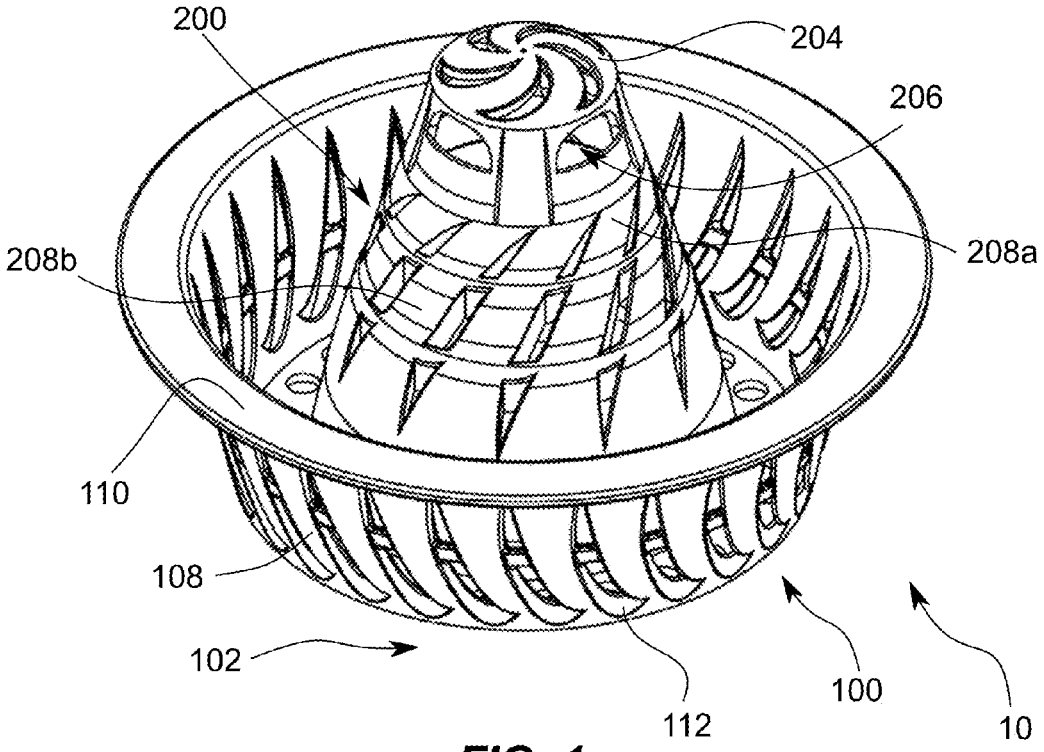
FIG. 1 illustrates a top perspective view of an embodiment of a strainer in a deployed position.

The following detailed description and the appended drawings describe and illustrate some embodiments of the disclosure for the purpose of enabling one of ordinary skill in the relevant art to make and use these embodiments. As such, the detailed description and illustration of these embodiments are purely illustrative in nature and are in no way intended to limit the scope of the disclosure in any manner. It should also be understood that the drawings are not necessarily to scale and in certain instances details may have been omitted, which are not necessary for an understanding of the embodiments, such as details of fabrication and assembly. In the accompanying drawings, like numerals represent like components.

In one embodiment of the disclosure, a strainer may include a basket portion including a base surface provided at a base end, an outer basket wall projecting away from the base surface, a basket flange provided on the outer basket wall opposite the base end, and at least one basket opening to permit passage of liquid through the basket portion. The strainer may also include a handle portion attached to the basket portion and projecting away from the base end, the handle portion having a top end defined opposite the base end. The handle portion may be movable between a deployed position and a compressed position, where the basket flange may be positioned between the top end and the base end in the deployed position and the basket flange may be positioned either substantially flush with the top end or the top end may be positioned between the basket flange and the base end in the compressed position.

In further embodiments, the handle portion may further include a dome provided proximate to the top end and a passage proximate to the dome. The handle portion may be substantially hollow and the tower portion may include at least one handle opening to permit passage of liquid through the handle portion. The at least one passage may be positioned between the top end and the basket flange in the deployed position. The handle portion may further include a dome provided proximate to the top end and a passage proximate to the dome, the passage may be sized to accept entry of a portion of a user's finger, and the at least one passage may be provided on the dome. The handle portion may further include a plurality of sections, and the plurality of sections may fold over each other in an accordion configuration in the compressed position. The handle portion may be substantially hollow and the handle portion may include at least one handle opening provided on at least one of the sections to permit passage of liquid through the handle portion. The base surface may be ring shaped having an inner circumference and an outer circumference, the outer basket wall projecting from the outer circumference, and the basket portion may be further comprising an inner basket wall projecting from the inner circumference, the inner basket wall including a support channel. The tower portion may further include a projection having dimensions conforming to the support channel, the projection provided within the support channel. The support channel and the projection may have an inverted "T" shape such that the lateral part of the "T" is proximate the base end and the longitudinal part of the "T" projects towards the top end. The basket portion may be a harder material than the handle portion. The handle portion may be silicone or rubber. The application of a force on the tower portion towards the base end may move the tower portion into the compressed position. The cessation of the force on the tower portion may result in the tower portion resiliently returning to the deployed position.

In another embodiment of the disclosure, a strainer may include a basket portion including a base surface having a ring shape with an inner circumference and an outer circumference, the base surface provided at a base end, an outer basket wall projecting away from the outer circumference of the base surface, with the outer basket wall including a wall slit to permit passage of liquid through the outer basket wall, an inner basket wall projecting away from the inner circumference of the base surface, the inner basket wall including a support channel, and a basket flange provided on the outer basket wall opposite the base end. The strainer may also include a handle portion including a dome at or proximate to the top end, a passage proximate to the dome, a plurality of sections attached to the dome, and a protrusion attached to at least one of the plurality of sections, the protrusion conformingly dimensioned with the support channel and positioned within the support channel.

In certain embodiments, the handle portion may be movable between a deployed position and a compressed position, and the plurality of sections may fold over each other in an accordion configuration in the compressed position. The basket flange may be positioned between the top end and the base end in the deployed position and the basket flange may be positioned either substantially flush with the top end or the top end may be positioned between the basket flange and the base end in the compressed position.

In further embodiments, the support channel and the projection may have an inverted "T" shape such that the lateral part of the "T" is proximate the base end and the longitudinal part of the "T" projects towards the top end. The handle portion may be silicone or rubber, and the basket portion may be harder material than the handle portion. The application of a force on the tower portion towards the base end may move the tower portion into the compressed position, and the cessation of the force on the tower portion may result in the tower portion resiliently returning to the deployed position.

With reference to the Figures, FIG. 1 depicts a top side perspective view on an embodiment of a waste strainer 10. Waste strainer 10 may include a basket or base portion 100 and a handle or tower portion 200 projecting away from a base end 102 of basket portion 100. Handle portion 200 may be constructed from a static, plastic, or elastic material, for example, plastics, polymers, metals, woods, silicones, rubbers, or combinations thereof.

Basket portion 100 may include a base surface 104 with a plurality of base apertures 106 in order to permit the passage of liquid through base surface 104. An outer basket wall 108 may project away from the circumferential ends of base surface 104. At the end of outer basket wall 108 opposite base end 102 may be a basket lip or flange 110 projecting radially away from basket wall 108. As utilized in a drain (not illustrated), basket 100 may be positioned within at least a portion of a drain such that at least a portion of outer basket wall 108 may be proximate to an inner drain wall while lip 110 sits on or otherwise contacts surface proximate to the drain opening such as a sink basin or shower floor.

In other embodiments, the outer edge of the basket lip 110 may be disposed of against the inner wall of a drain. Thus the basket lip 110 can compress against said inner wall of the drain to hold the waste strainer 10 in place in the particular drain.

Basket wall 108 may also include a plurality of draining slits or passages 112 in order to permit the passage of liquid through outer basket wall 108. In the illustrated embodiment, base apertures 106 have a substantially circular shape while wall slits 112 have a substantially falcate shape, and base apertures 106 and wall slits 112 are evenly distributed across their respective surfaces, however other shapes and orientations having ornamental or functional advantages known to persons of ordinary skill in the art are contemplated within the disclosure. Base apertures 106 and wall slits 112 may be collectively referred to herein as basket openings.

In some embodiments base surface 104 is substantially circular with handle portion 100 attached to and projecting away from base surface 104. In other embodiments, such as the illustrated embodiment, base surface is substantially ring-shaped with outer basket wall 108 projecting away from an outer perimeter of base surface 104 and an inner basket wall 114 projecting away from an inner perimeter of base surface 104. Outer basket wall 108 and inner basket wall 114 may be substantially parallel, with less than about 30 degrees of variation in the angles of the wall with respect to base surface 104. Although not shown in the illustrated embodiment, inner basket wall may include one or more wall slits 112. Inner basket wall 114 may also include one or more support channels 116, which in the illustrated embodiment are each substantially "T" shaped. Support channels 116 may be utilized to secure handle portion 200 with basket portion 100 as further described herein.

Figure 2:
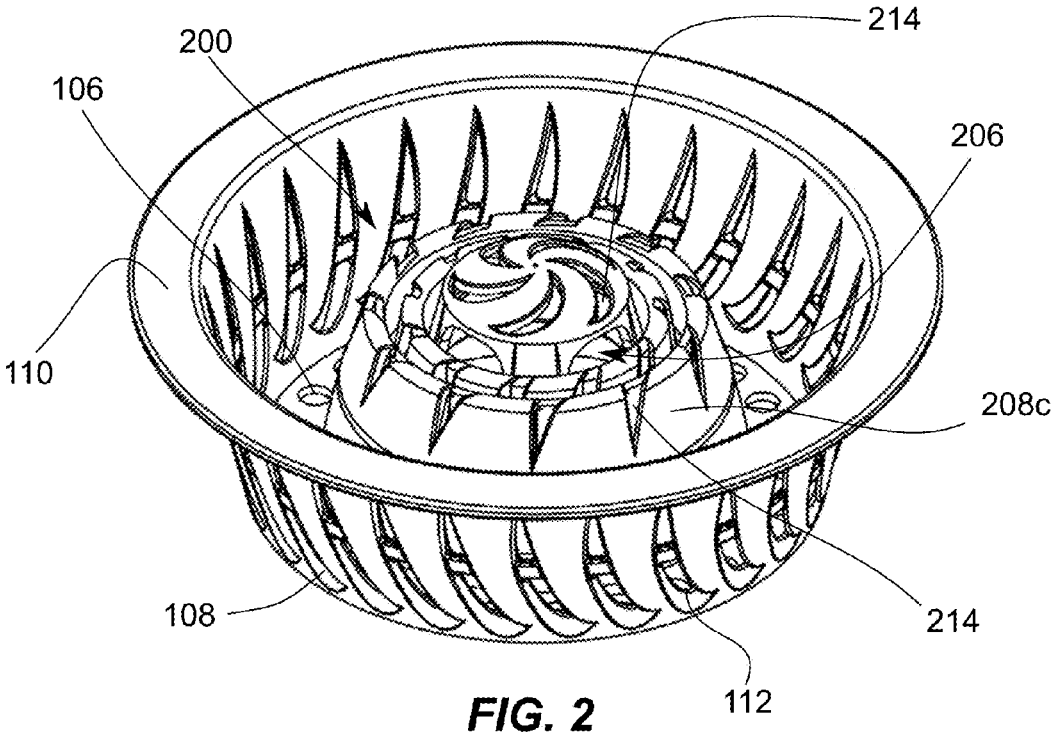
FIG. 2 illustrates a top perspective view of the strainer of FIG. 1 in a compressed position.

In certain embodiments, handle portion 200 may be forcibly moved between an erect or deployed position, as shown in FIG. 1, and a compressed or stored position, as shown in FIG. 2. A top end 202 of handle portion is defined opposite bottom end 102, and at top end 202 of handle portion 200 may be a dome or peak 204. A passage 206 may be provided below dome 204, with the passage sufficiently sized to grasp the dome 204 and remove said dome 204 from the drain. In certain embodiments, the passage 206 may be appropriately sized such that a portion of a user's finger or fingers can be inserted into the passage 206 thereby permitting a user to pull the dome 204, and consequentially the entire strainer 10, upwards in a direction away from base end 102. Passage 206 may include a plurality of openings, and in the illustrated embodiment passage 206 includes four (4) openings with arcuate shaped upper ends. Furthermore, passage 206, by sitting above the rim 110, allows for continual draining even when the wall slits 112 and base apertures 106 are clogged.

Figure 11:
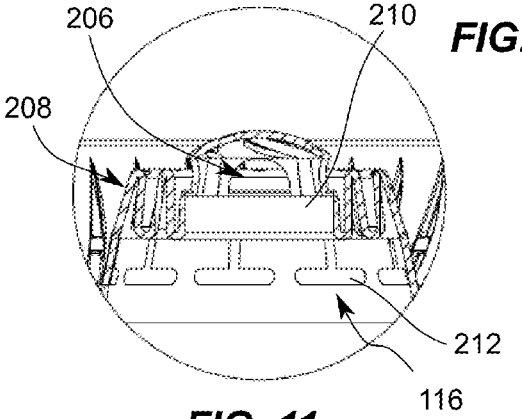
FIG. 11 illustrates an exploded view of the area marked "D" of the strainer of FIG. 10.

Connected to dome 204 may be a plurality of levels or sections 208, which may collapse or fold over each other in the compressed position via accordion or nested fashion. FIG. 11 in particular shows this folded nature of sections 208 in the compressed position. In the illustrated embodiment, three (3) sections 208*a*, 208*b*, 208*c* are illustrated. In the deployed position, sections 208 may form a tower with the lowest section 208*c* closest to the base end 102 having the greatest circumference with the adjacent section 208*b* have a smaller circumference and the highest section 208*a* closest to the top end 202 having the smallest circumference. This gradual change in circumferences between sections 208 may assist the sections to folder over in nested like fashion to allow the done 202 to compress below the rim 110. Further embodiments contemplate sections 208 retracting into the compressed position in a manner other than an accordion or nested fashion, for instance by telescoping over each other or twisting in a threaded-like movement, in order to collapse onto each other.

Dome 204 may be attached to sections 208 either directly or through an intermediary element 210. Sections 208 may be attached to basket portion 100 by one or more protrusions 212, each conformingly dimensioned to engage with a support channel 116. In the illustrated embodiment, both protrusions 212 and support channel 116 are substantially shaped as an inverted "T", which permits an increase in force distribution emanating from a user pulling on dome 204 and applying to basket portion 100 via protrusions 212 and channels 116. Protrusions 212 may be forcibly push fitted into channels 116, or strainer may be manufactured or molded so such that protrusions 212 are pre-fitted into channels 116. This allows the strainer to be manufactured separately, from two or more materials, typically one for the tower and one for the base portion. Alternatively, the strainer may be manufactured from a single material, or two or more materials in a single mold.

Handle portion 200 may be substantially hollow and a plurality of handle openings 214 may be provided along sections 208 or dome 204, or both as shown in the illustrated embodiment, thereby permitting liquid drainage through the interior of handle portion 200. At least a portion of the handle openings 214 may be placed at a position between basket lip 110 and top end 202, such as on upper sections 208*a*, 208*b* as well as on dome 204. By positioning handle openings 214 proximate to top end 202, liquid drainage may occur even if base apertures 104 and wall slits 112 are blocked with debris or waste. As with base apertures 106 and wall slits 112, a variety of shapes known to persons of ordinary skill in the art are contemplated within the disclosure for handle openings 214 as well as passage 206.

Handle portion 200 may be in a deployed position in its natural state of rest. Applying a downward force on dome 204 in a direction towards base end 102 may then result in handle portion forcibly transforming into the compressed position. In its compressed position, top end 202 of dome 204 may be moved to a position that is substantially flush with, or even below, basket lip 110. In the illustrated embodiment, dome is substantially flush with basket lip 110 such that the majority of dome 204 is below basket lip 110.

However, in one possible embodiment, the strainer 10 is manufactured wherein the handle portion 200 is manufactured wherein the dome cannot be compressed. Indeed, as the handle portion 200 extends above the basket lip 110, the strainer 10 can continue to allow water to drain through the strainer, even when the entire basket is otherwise full of debris. Indeed, having this extended central portion ensures that the drain continues to function absent a complete and total blockage of both the basket and of the handle portion 200. This feature is present whether or not the handle portion 200 is manufactured so as to prevent compression, or if the handle portion 200 compresses, as is depicted in, for example, FIG. 2.

Accordingly, in one possible environmental example of strainer 10 in operation, basket portion 100 of strainer 10 may be placed in a kitchen sink drain and a pot or pan be placed on strainer 10 thereby providing a downward force on dome 204 resulting in a transformation to the compressed position such as depicted in FIG. 2. In this example, the compressed position would sufficiently move dome 204 downward so as to permit the pot or pan to rest on strainer 10 without excessive interference from dome 204, meaning the placed pot or pan would not significantly tilt, or have any tilt, while it rests on strainer 10. The pot or pan may be removed, and the handle portion 100 may elastically return to its deployed position. In the deployed position, as the basket portion 100 accumulates waste, handle openings 212 may permit liquid drainage to continue even as wall slits 112 and base apertures 106 become blocked with waste. Moreover, a user may engage her finger, or at least a portion of her finger such as the tip of a finger, with passage 206 and upwardly pull dome 204, thereby removing strainer 10 from the sink drain while the user's fingers avoid contact with the waste accumulated in basket portion 100.

Figure 3:
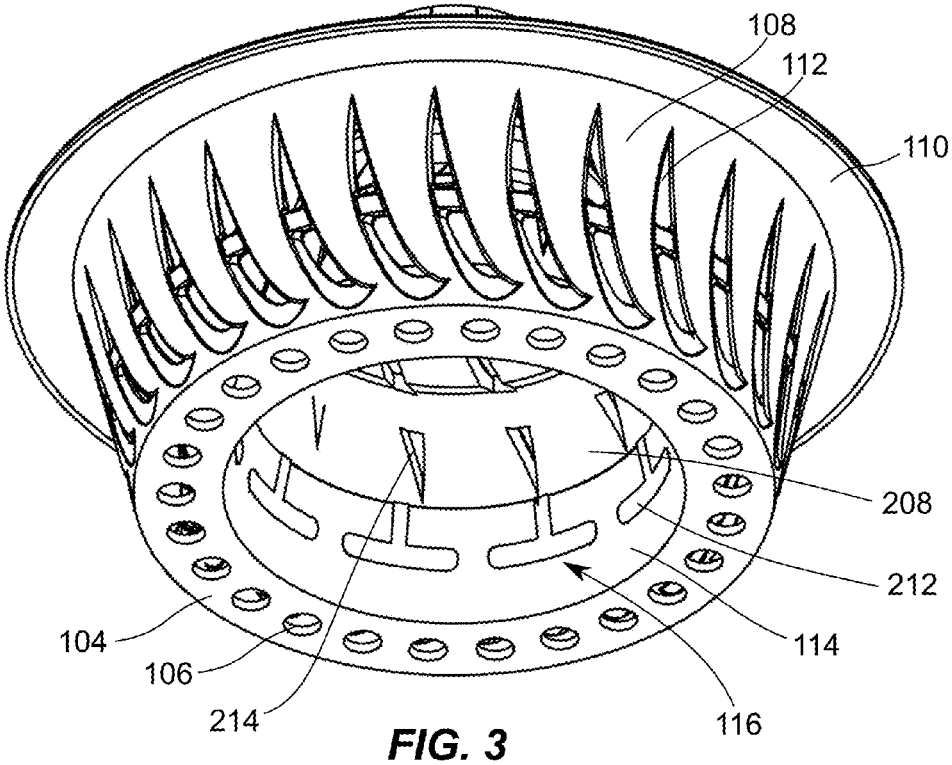
FIG. 3 illustrates a bottom perspective view of the strainer of FIG. 1 in a deployed position.

FIG. 3 illustrates a bottom perspective view of the strainer of FIG. 1 in a deployed position. Accordingly, the hollow nature of the handle portion 200 is clearly seen from the underside to allow for water to drain through the handle portion 200. At the same time, the base apertures 106 and slits 112 provide for water to drain through the openings in the basket.

Figure 4:
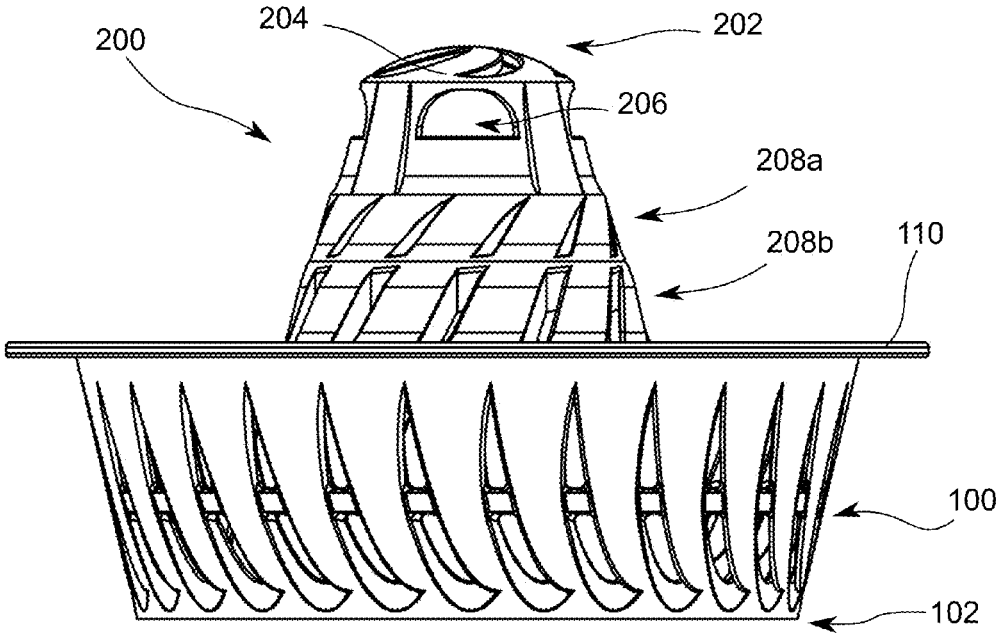
FIG. 4 illustrates a side view of the strainer of FIG. 1 in a deployed position. The front, rear, and opposing side view the same as this side view.

FIG. 4 illustrates a side view of the strainer of FIG. 1 in a deployed position. The front, rear, and opposing side view the same as this side view. Indeed, the dome 204 and the handle 200 are clearly depicted as extending above the basket lip 110 wherein the openings in the handle 200 allow for draining of water or other liquids, if and when the basket is otherwise clogged. Yet, at the same time, the done 204 also allows for easy removal of the strainer 10 without having to contact the debris within the basket.

Figure 5:
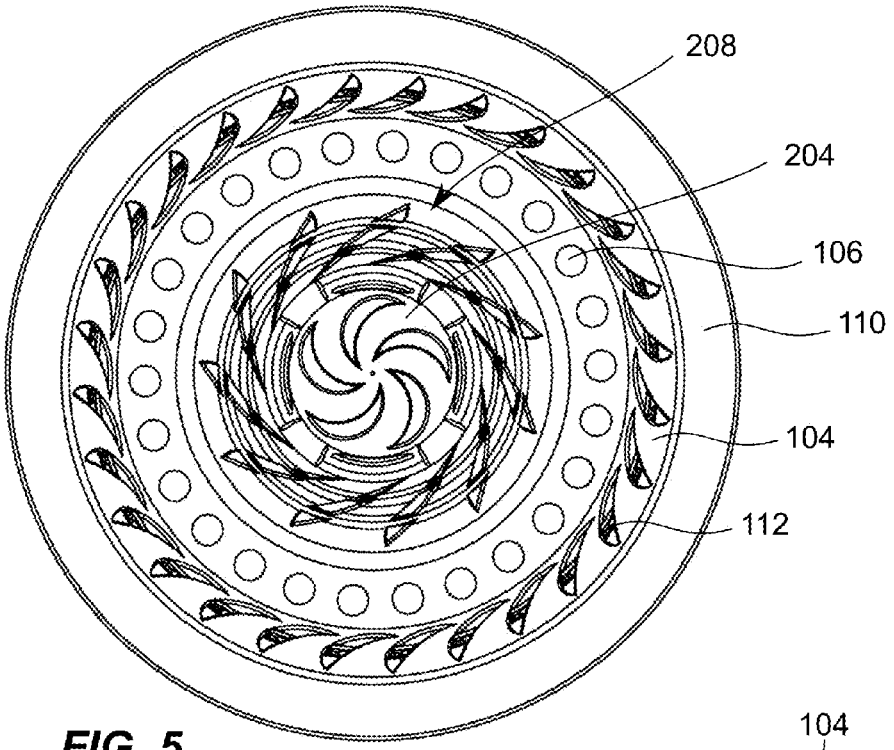
FIG. 5 illustrates a top view of the strainer of FIG. 1 in a deployed position.
Figure 6:
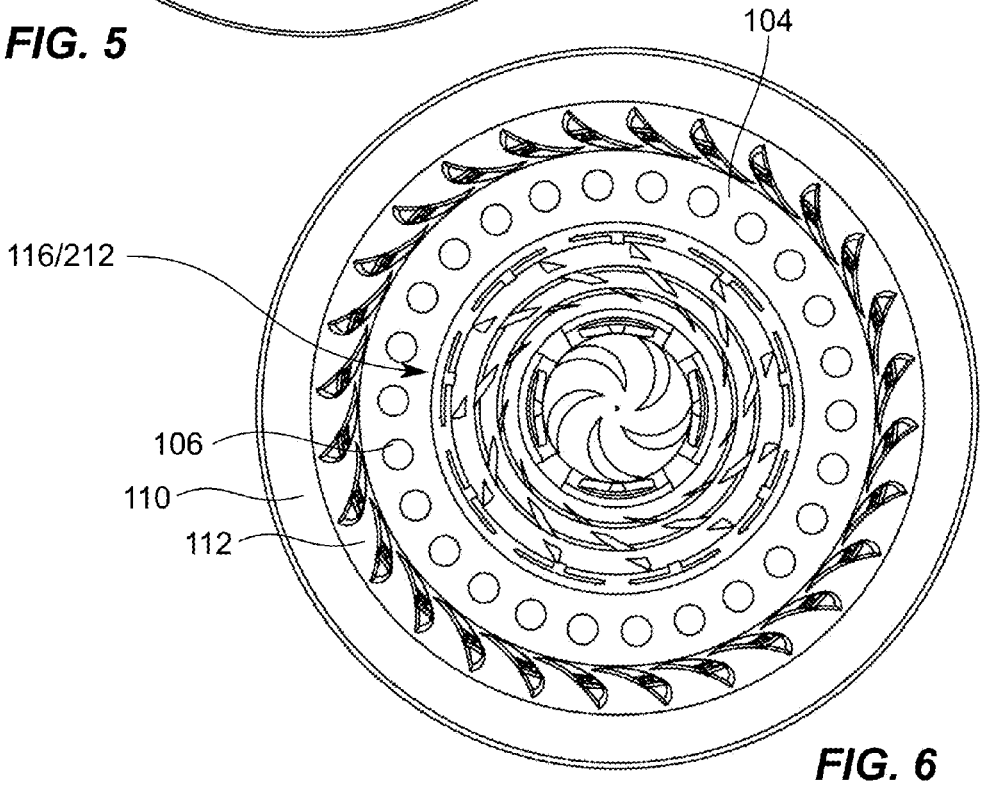
FIG. 6 illustrates a bottom view of the strainer of FIG. 1 in a deployed position.

In certain embodiments, the strainer 10 can then simply be disposed of, such that the strained materials and the strainer 10 are disposed of together. In other embodiments FIGS. 5 and 6 illustrate various views of the top and bottom of the strainer of FIG. 1 in a deployed position.

Figure 7:
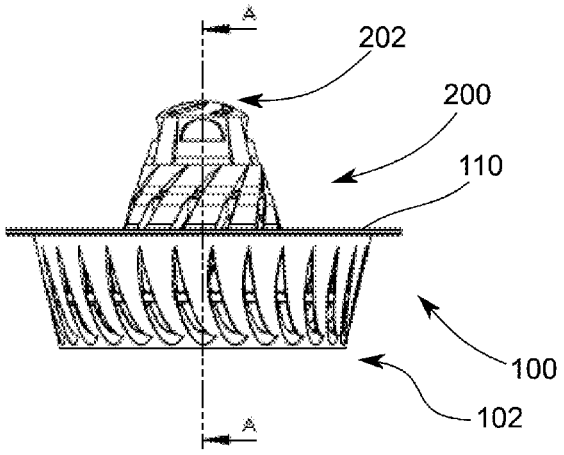
FIG. 7 illustrates a side view of the strainer of FIG. 1 in a deployed position.
Figure 8:
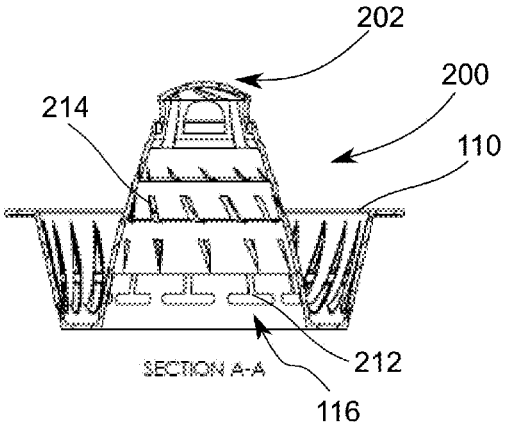
FIG. 8 illustrates a cross-section view along plane "A-A" of the strainer of FIG. 7.
Figure 9:
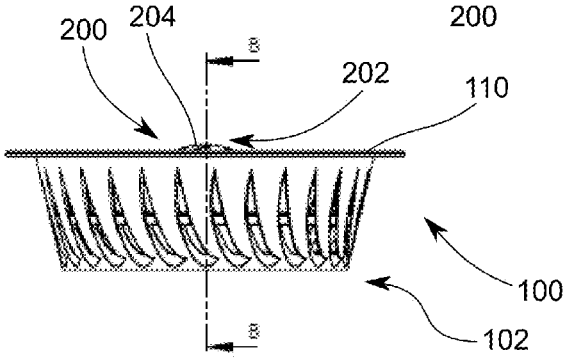
FIG. 9 illustrates a side view of the strainer of FIG. 1 in a compressed position.

FIG. 7, like FIG. 4 above, illustrates a side view of the strainer of FIG. 1 in a deployed position. A detail in a cross-sectional view along plane "A-A" is provided by FIG. 8. Similarly, FIG. illustrates a side view of the strainer of FIG. 1 in a compressed position and FIG. 10 illustrates a cross-section view along plane "B-B" of the strainer of FIG. 9.

Figure 10:
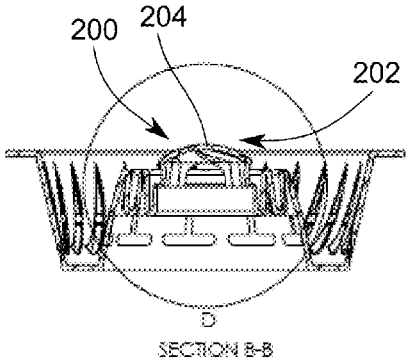
FIG. 10 illustrates a cross-section view along plane "B-B" of the strainer of FIG. 9.

FIG. 11 illustrates an exploded view of the area marked "D" of the strainer of FIG. 10. This provides greater detail of one embodiment may fold the handle portion down. The top of the dome 204 is depicted as slightly above the basket lip 110, however, in certain embodiments and upon application of a force to this dome 204, the dome will compress below the edge of, or adjacent to the edge of the basket lip 110. This enables a flat bottomed device to be placed upon the strainer 10 and to be able to sit flat on the bottom of the drain, without tilting significantly due to the dome 204 protruding above the edge of the basket lip 110.

Figure 12:
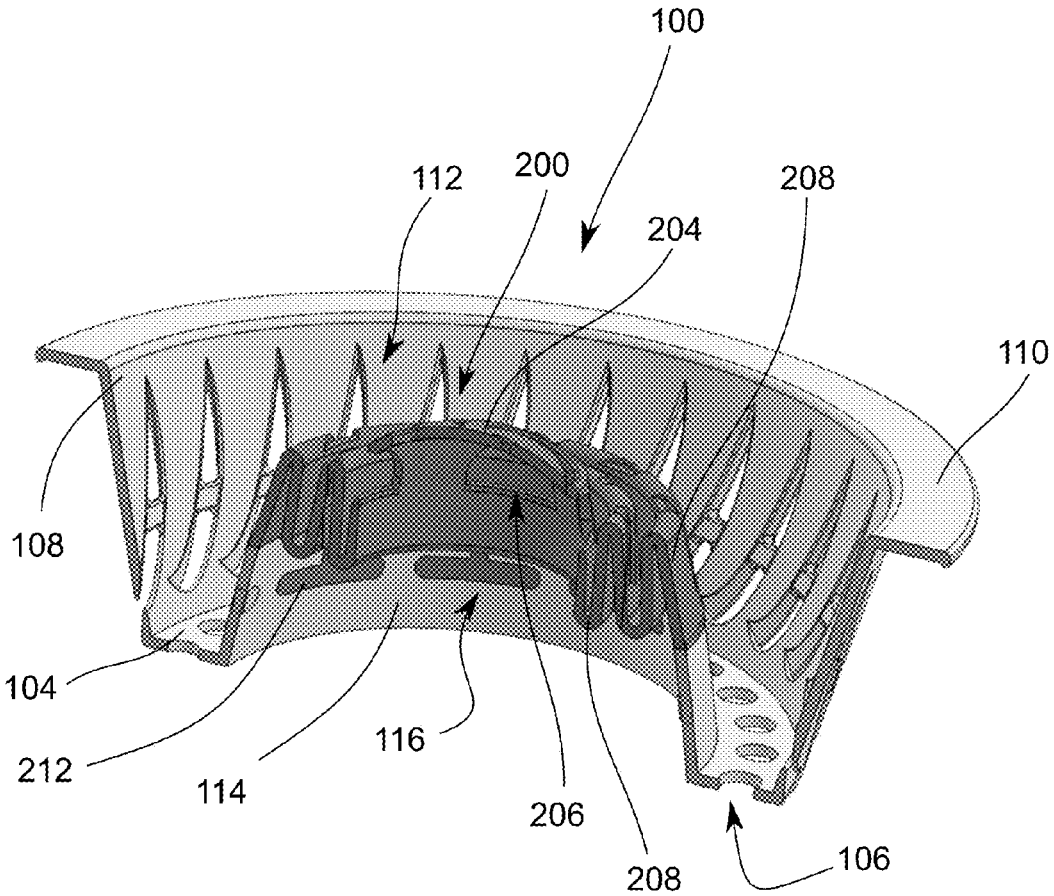
FIG. 12 illustrates a side perspective cross-section view of the strainer of FIG. 1 in a compressed position.

FIG. 12 illustrates a further depiction of a side perspective cross-section view of the strainer of FIG. 1 in a compressed position.

The descriptions set forth above are meant to be illustrative and not limiting. Various modifications of the embodiments, in addition to those described herein, will be apparent to those skilled in the art from the foregoing description. Such modifications are also intended to fall within the scope of the concepts described herein. Each patent, patent application and publication cited or described in this document are hereby incorporated herein by reference, in their entireties.

The foregoing description of possible implementations consistent with the present disclosure does not represent a comprehensive list of all such implementations or all variations of the implementations described. The description of some implementation should not be construed as an intent to exclude other implementations. For example, artisans will understand how to implement the embodiments in many other ways, using equivalents and alternatives that do not depart from the scope of the disclosure. Moreover, unless indicated to the contrary in the preceding description, none of the components described in the implementations are essential to the embodiments disclosed. It is thus intended that the embodiments be considered as illustrative, with a true scope and spirit of the disclosure being indicated by the following claims.

REFERENCE LIST

10 Strainer
100 Basket Portion
102 Base End
104 Base Surface
106 Base Aperture
108 Outer Basket Wall
110 Basket Flange
112 Wall Slits
114 Inner Basket Wall
116 Support Channel
200 Handle Portion
202 Top End
204 Dome
206 Passage
208 Handle Section
210 Intermediary Section
212 Protrusion
214 Handle Opening

What is claimed:

1. A strainer comprising:

a basket portion including a base surface having a ring shape with an inner circumference and an outer circumference, the base surface provided at a base end, an outer basket wall projecting away from the outer circumference of the base surface, the outer basket wall include a wall slit to permit passage of liquid through the outer basket wall, an inner basket wall projecting away from the inner circumference of the base surface, the inner basket wall including a support channel, and a basket flange provided on the outer basket wall opposite the base end; and a handle portion attached to the basket portion and projecting away from the base end, the handle portion having a top end defined opposite the base end, the handle portion including a dome at or proximate to the top end, a passage proximate to the dome, a plurality of sections attached to the dome, and a protrusion attached to at least one of the plurality of sections, the protrusion conformingly dimensioned with the support channel and positioned within the support channel, wherein the handle portion is movable between a deployed position and a compressed position, the plurality of sections fold over each other in an accordion configuration in the compressed position, and wherein the basket flange is positioned between the top end and the base end in the deployed position and the basket flange is positioned either substantially flush with the top end or the top end is positioned between the basket flange and the base end in the compressed position.

2. The strainer of claim 1 wherein the support channel and the projection have an inverted "T" shape such that the lateral part of the "T" is proximate the base end and the longitudinal part of the "T" projects towards the top end.

3. The strainer of claim 1 wherein the handle portion is silicone or rubber, and the basket portion is harder material than the handle portion.

4. The strainer of claim 1 wherein the application of a force on the tower portion towards the base end moves the tower portion into the compressed position, and wherein the cessation of the force on the tower portion results in the tower portion resiliently returning to the deployed position.

* * * * *